US006223375B1

(12) United States Patent
Vaughan, Jr.

(10) Patent No.: US 6,223,375 B1
(45) Date of Patent: May 1, 2001

(54) DRILLING AND FASTENER DRIVING TOOL

(75) Inventor: James C. Vaughan, Jr., Dacula, GA (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 09/379,759

(22) Filed: Aug. 24, 1999

(51) Int. Cl.[7] ..... B25B 13/00
(52) U.S. Cl. ..... 7/138
(58) Field of Search ..... 7/158, 165, 138, 7/901; 279/143, 144, 145

(56) References Cited

U.S. PATENT DOCUMENTS

| | | | | |
|---|---|---|---|---|
| 3,932,904 | * | 1/1976 | Nilsson et al. | 7/14.1 R |
| 3,965,510 | | 6/1976 | Ernst . | |
| 4,107,800 | | 8/1978 | Jorgensen . | |
| 4,191,227 | | 3/1980 | Venter . | |
| 4,296,656 | | 10/1981 | Ernst . | |
| 4,588,335 | | 5/1986 | Pearson, Jr. . | |
| 4,617,844 | | 10/1986 | Batten . | |
| 4,810,139 | | 3/1989 | Regan . | |
| 4,818,157 | * | 4/1989 | Kouvelis | 408/240 |
| 5,110,145 | | 5/1992 | Stewart . | |
| 5,168,781 | | 12/1992 | Tenuta . | |
| 5,191,666 | * | 3/1993 | Corbin | 7/158 |
| 5,313,680 | * | 5/1994 | Ringler | 7/138 |
| 5,409,333 | * | 4/1995 | Hu | 408/239 A |
| 5,490,683 | | 2/1996 | Mickel et al. . | |
| 5,586,847 | * | 12/1996 | Mattern, Jr. et al. | 408/239 |
| 5,651,647 | * | 7/1997 | Ray | 408/239 A |
| 5,782,570 | | 7/1998 | Masterson et al. . | |
| 5,810,367 | | 9/1998 | Holzer, Jr. et al. . | |
| 5,829,929 | | 11/1998 | Lewis . | |
| 5,897,121 | | 4/1999 | Case . | |
| 5,908,076 | | 6/1999 | Marcengill et al. . | |
| 5,913,509 | | 6/1999 | Price et al. . | |

OTHER PUBLICATIONS

Condrive JR Installation Tool User Instructions, Copyright 1997.

* cited by examiner

*Primary Examiner*—Timothy V. Eley
*Assistant Examiner*—Dung Van Nguyen
(74) *Attorney, Agent, or Firm*—Lisa M. Sohis; Mark W. Croll; John P. O'Brien

(57) ABSTRACT

A drilling and wrenching tool for use with a rotary power tool and combinations thereof. The tool includes a drill adapter having a drill bit protruding from a drill shank thereof, and a sleeve member having a first end with a first opening and a second opposite end with a second opening. The first opening of the sleeve member has a first sleeve engagement surface and a first fastener engagement surface, and the second opening has a second sleeve engagement surface and a second fastener engagement surface. The drill shank is axially disposable into the first or second opening of the sleeve member, and an outer shank engagement surface of the drill shank is engagable with the first or second sleeve engagement surface to impart rotation from the rotary power tool to the sleeve member.

27 Claims, 3 Drawing Sheets

DRILLING AND FASTENER DRIVING TOOL

BACKGROUND OF THE INVENTION

The invention relates generally to combination drilling and fastener driving tools for use with power drills and combinations thereof.

Combination drilling and fastener driving tools for use with rotary power driving tools including hand-held drills and hammer drills are known generally. These combination tools are used commonly in applications where it is necessary to first drill a hole into a workpiece, for example into concrete, and then drive a threaded fastener into the hole, especially where the drilling and wrenching operations are performed repeatedly. See for example U.S. Pat. No. 3,965,510 entitled "Combination Drilling and Wrenching Tool", assigned to the assignee of the present application, which discloses a combination drilling and wrenching tool for use with an electric power drill. Several aspects of the combination tools disclosed in U.S. Pat. No. 3,965,510 are embodied in the commercially available CONDRIVE 2000 compact high speed installation tool for the TAPCON concrete fastening system, both by ITW Buildex, Itasca, Ill.

Another known combination drilling and wrenching tool for use with rotary power driving tools is the CONDRIVE 1000 compact high speed installation tool for the TAPCON concrete fastening system, also by ITW Buildex, Itasca, Ill. The CONDRIVE 1000 tool comprises generally a drill adapter couplable to a first end of a hollow sleeve member having a receptacle on an opposite end thereof for receiving various fastener driving sockets and screw driving bits. The drill adapter portion of the CONDRIVE 1000 tool includes a chuck shank on one end and a hex shape drill shank on an opposite end thereof. The chuck shank is mounted in a chuck of a power drill, and the drill shank has a concentric axial bore for receiving a drill bit, which is secured therein by a set screw. After drilling a hole in the work piece, the drill bit and the drill shank are conveniently disposed and retained in a hex shape opening in the first end of the sleeve member, and the appropriate fastener driving socket or screw driving bit is selected and disposed in a hex shape opening in the opposite end of the sleeve member, whereupon the fastener is power driven into the work piece.

Combination drilling and wrenching tools are also useful in applications that require the drilling of a pilot hole into a workpiece and the subsequent driving of a fastener into the pilot hole, especially where the drilling and fastener driving operations are performed repeatedly.

The present invention is drawn generally toward advancements in the art of combination drilling and wrenching tools for use with rotary power tools.

An object of the invention is to provide novel combination drilling and wrenching tools for use with rotary power tools and combinations thereof that overcome problems in the art.

Another object of the invention is to provide novel combination drilling and wrenching tools for use with rotary power tools and combinations thereof that are reliable and economical.

Another object of the invention is to provide novel combination drilling and wrenching tools for use with rotary power tools and combinations thereof having fewer components.

A further object of the invention is to provide novel combination drilling and wrenching tools for use with rotary power tools and combinations thereof that accommodate different size hex head fasteners but do not require separate hex drive sockets.

A more particular object of the invention is to provide novel combination drilling and wrenching tools comprising generally a drill adapter and a sleeve member. The drill adapter includes a chuck shank on one end thereof and a drill shank on an opposite end thereof, and the sleeve member includes a first end with a first opening and a second opposite end with a second opening. The first opening of the sleeve member has a first sleeve engagement surface and a first fastener engagement surface, and the second opening has a second sleeve engagement surface and a second fastener engagement surface. The drill shank is axially disposable into the first or second opening of the sleeve member, and an outer shank engagement surface of the drill shank is engagable with the first or second sleeve engagement surface to rotationally engage the drill adapter and the sleeve member.

Another more particular object of the invention is to provide novel drilling and wrenching systems comprising generally a rotary power tool retaining a drill adapter having a drill bit protruding from a drill shank thereof, and a sleeve member having a first end with a first opening and a second opposite end with a second opening. The first opening of the sleeve member has a first sleeve engagement surface and a first fastener engagement surface, and the second opening has a second sleeve engagement surface and a second fastener engagement surface. The drill shank and drill bit are axially disposable into the first or second opening of the sleeve member, and an outer shank engagement surface of the drill shank is engagable with the first or second sleeve engagement surface to impart rotation from the rotary power tool to the sleeve member.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
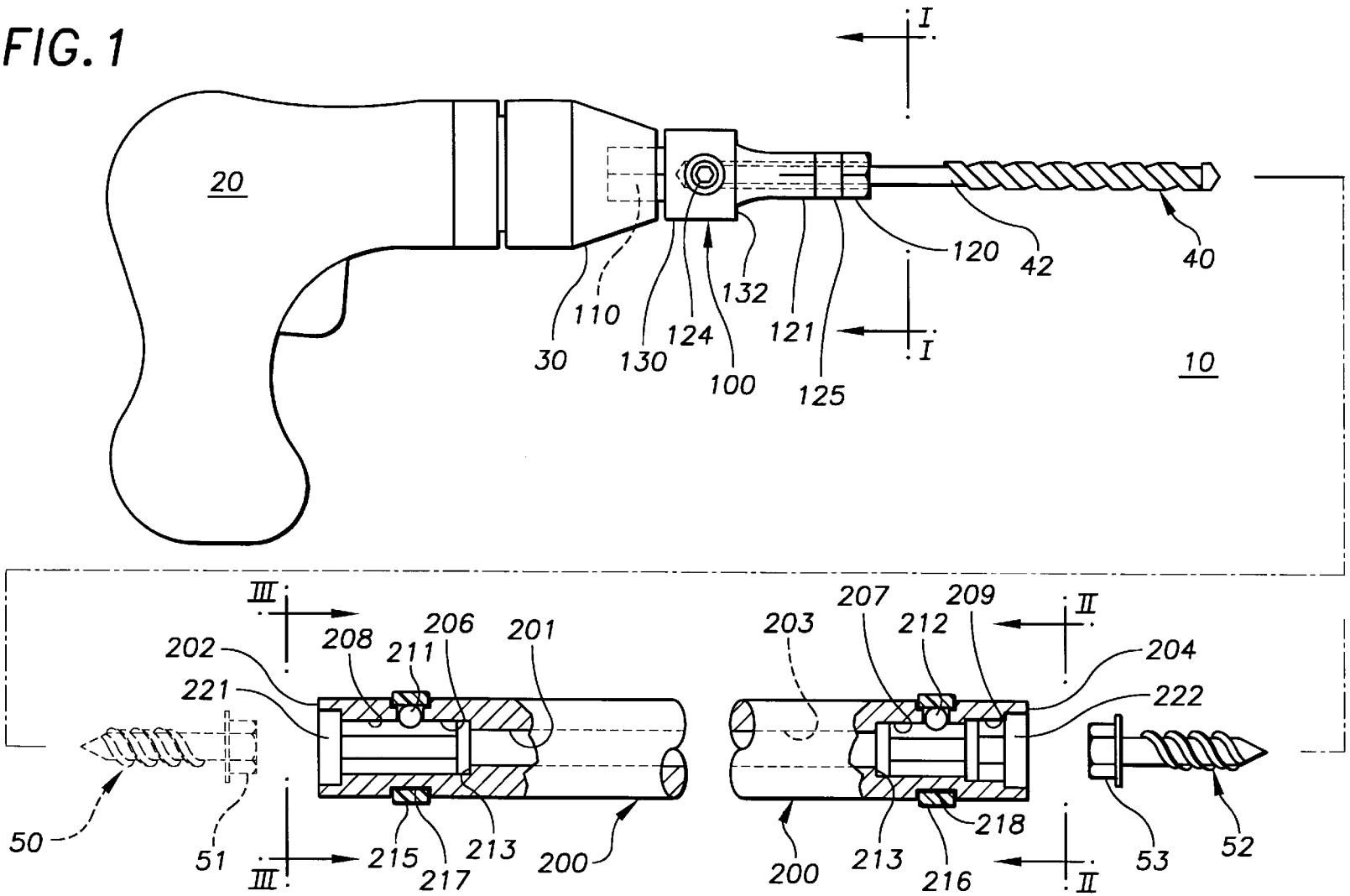
FIG. 1 is a partial sectional view of a drilling and wrenching system according to an exemplary embodiment of the invention.

FIG. 1 is a drilling and wrenching system 10 comprising generally a rotary power tool 20 having a rotatable chuck 30 and a combination drilling and wrenching tool, which is discussed in further detail below. The rotary power tool 20 may be a hand-held electric drill, or a hammer drill, or any other rotary power tool having a rotatable chuck for engaging and retaining a drill bit, as is known generally.

Generally, the combination drilling and wrenching tool comprises generally a drill adapter connectable to the rotary power tool and a sleeve member having opposite ends, either of which is connectable to the drill adapter. The drill adapter has associated therewith a drill bit or means for retaining a drill bit, and the sleeve member has first and second fastener engagement surfaces formed in corresponding first and second openings at the opposite ends thereof for engaging and power wrenching different size fasteners, without the use of separate sockets required by prior art combination drilling and wrenching tools. A screw driver bit or socket is also connectable to one or both of the ends of the sleeve member for driving fasteners with Philips or standard or hex or other wrenching recesses.

In the exemplary embodiment of FIG. 1, a drill adapter 100 comprises a chuck shank 110 on one end thereof and a drill shank 120 on an opposite end thereof. The chuck shank and drill shank are aligned axially, along a common axis. The drill adapter 100 also preferably includes an adapter body 130, which has a cylindrical shape in the exemplary embodiment, disposed axially between the chuck shank 110 and drill shank 120.

The exemplary chuck shank 110 has a square shape sectional configuration, but in other embodiments the chuck shank 110 may have any polygonal shape or even a cylindrical shape or other engagable surface configuration. The chuck shank 110 is disposable and retainably engaged by the chuck 30 of the rotary power tool, as is known generally.

Figure 5:
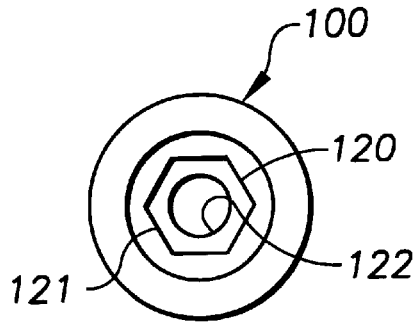
FIG. 5 is a partial end view of the drill adapter, without the drill bit therein, viewed along lines I—I of FIG. 1.

The drill shank 120 has an outer shank engagement surface 121, which in the exemplary embodiment of FIG. 5 is a hexagonal shape. In other embodiments however the shank engagement surface of the drill shank 120 may have any polygonal shape or other sectional shape or configuration, for example a protrusion, that will engage the sleeve member when the drill shank is connected to one of the end portions thereof to prevent relative rotation therebetween, as discussed further below.

In FIG. 1, a drill bit 40 protrudes axially from the drill shank 120. FIG. 5 illustrates the drill shank 120 preferably having an axial bit bore 122 disposed therein for accommodating a shank 42 of the drill bit 40. In FIG. 1, a set screw 124 is disposed through a side portion of the adapter body 130 and into the axial bit bore where the set screw engages and retains a bit shank 42 disposed in the axial bit bore, as is known generally. Thus configured, drill bits are removably disposable in the drill adapter.

The sleeve member is a generally cylindrical member having an axial dimension and a round sectional outer surface. In other embodiments, the outer surface of the generally cylindrical sleeve member may have a polygonal shape sectional outer surface or other configuration. The sleeve member also comprises generally a first end with a first opening and a second end with a second opening. The first opening has a first inner sleeve engagement surface and a first fastener engagement surface, and the second opening has a second inner sleeve engagement surface and a second fastener engagement surface. The drill shank is axially disposable into either one of the first or second openings of the sleeve member, and the outer shank engagement surface of the drill shank is engagable with the first or second sleeve engagement surface of the corresponding first or second opening to rotationally engage the drill adapter and the sleeve member.

In FIG. 1, a sleeve member 200 has a first end 202 with a first axial opening 201 and a second opposite end 204 with a second axial opening 203. In the exemplary embodiment, the sleeve member 200 is hollow and thus the first and second openings 201 and 203 meet to form a continuous axial opening extending fully through the sleeve member. In other embodiments, however, the first and second openings 201 and 203 extend into the sleeve member 200 only so far as is required to accommodate the drill bit 40 when the drill shank 120 is disposed into the first or second opening and engaged with the corresponding first or second sleeve engagement surface thereof, as discussed below.

The first axial opening 201 has a first sleeve engagement surface 206 and a first fastener engagement surface 208 disposed between the first sleeve engagement surface 206 and the first end 202 of the sleeve member. The second axial opening 203 has a second sleeve engagement surface 207 and a second fastener engagement surface 209 disposed between the second sleeve engagement surface 207 and the second end 204 of the sleeve member.

The first fastener engagement surface 208 is preferably sized differently than the second fastener engagement surface 209 to accommodate different size fasteners, for example different fasteners 50 and 52 having different size hex heads 51 and 53. In the exemplary embodiment, the first fastener engagement surface 208 comprises a portion of the first sleeve engagement surface 206 so that the first fastener engagement surface 208 is the same as the first sleeve engagement surface 206. More generally, however, the first fastener engagement surface 208 may be sized differently than the first sleeve engagement surface 206. For example, the second fastener engagement surface 209 has a greater diameter than the second sleeve engagement surface 207.

Figure 6:
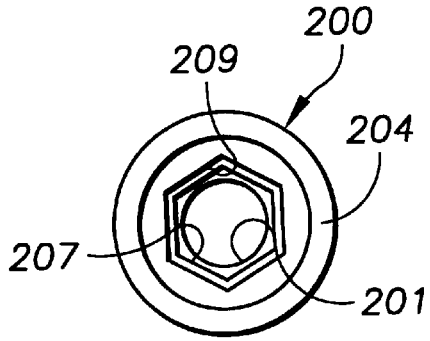
FIG. 6 is a partial end view of an end of the sleeve member viewed along lines II—II of FIG. 1.
Figure 7:
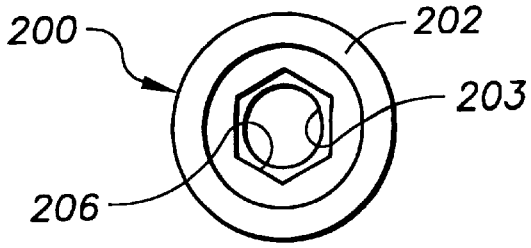
FIG. 7 is a partial end view of an opposite end of the sleeve member viewed along lines II—III of FIG. 1.

In the exemplary embodiment, the outer shank engagement surface 121 of the drill shank 120 has a generally polygonal shape, and more particularly in FIG. 5 a hex sectional shape. In FIGS. 6 and 7, the first and second sleeve engagement surfaces 206 and 207 of the sleeve member 200 are sized the same and have a polygonal shape that is complementary to the polygonal shape of the outer shank engagement surface 121 of FIG. 5. Thus the drill shank 120 is disposable into either one of the first or second openings 201 or 203 of the sleeve member, and the outer shank engagement surface 121 of the drill shank is engagable with one of the corresponding first or second sleeve engagement surfaces 206 or 207 to impart rotation from the rotary power tool 20 to the sleeve member 200.

Figure 2:
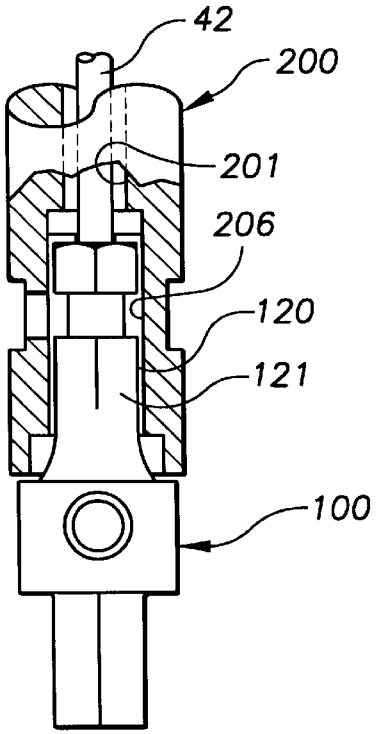
FIG. 2 is partial sectional view of a drill adapter coupled to an end portion of a sleeve member of a combination drilling and wrenching tool according to an exemplary embodiment of the invention.

FIG. 2 illustrates the drill adapter 100 and more particularly the drill shank 120 thereof and a portion of the bit shank 42 protruding therefrom disposed in the first opening 201 of the sleeve member 200 wherein the shank engagement surface 121 of the drill adapter is engaged with the first sleeve engagement surface 206 to rotationally engage the drill adapter 100 and the sleeve member 200. Thus configured, referring now to FIG. 1, the second fastener engagement surface 209 may be used to drive the fastener 52 into a hole drilled by the drill bit.

Figure 3:
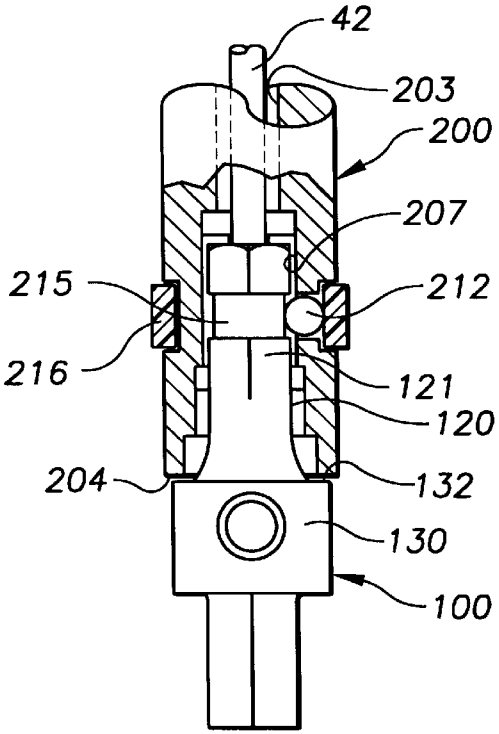
FIG. 3 is partial sectional view of a drill adapter coupled to an opposing end portion of the sleeve member of the combination drilling and wrenching tool according to an exemplary embodiment of the invention.

FIG. 3 illustrates the drill shank 120 and a portion of the bit shank 42 protruding therefrom disposed in the second opening 203 of the sleeve member 200 wherein the shank engagement surface 121 of the drill adapter is engaged with the second sleeve engagement surface 207 to rotationally engage the drill adapter 100 and the sleeve member 200. Thus configured, referring now to FIG. 1, the first fastener engagement surface 208 may be used to drive the fastener 50 into a hole drilled by the drill bit.

The combination drill adapter 100 and reversible sleeve member 200 thus permits drilling holes and power wrenching different size fasteners, or at least fasteners having different head sizes without separate sockets that must be interchangeably connected to the end of the sleeve member as in prior art combination drilling and wenching tools.

FIG. 1 illustrates the sleeve member 200 further comprising a first recess engagement member 211 biased to protrude into the first opening and particularly through the first sleeve engagement surface 206, and a second recess engagement member 212 biased to protrude through the second sleeve engagement surface 207. In the exemplary embodiment, the first and second recess engagement members are balls retained in an opening by corresponding resilient bands 215 and 216 disposed thereabout and seated in corresponding annular recesses 217 and 218 disposed about the sleeve member. In the exemplary embodiment, the balls 211 and 212 are metal and the resilient bands are formed of a polymer or plastic material.

In FIG. 1, the drill shank 120 of the drill adapter 100 preferably comprises a recess formed on the outer portion thereof, and preferably an annular recess 125 formed about the outer shank engagement surface 121 thereof. FIG. 3 illustrates the second recess engagement member 212 biased to protrude into the second axial opening 203 of the sleeve member where it is engaged with the recess 215 of the drill adapter to axially retain the drill shank 120 in the second opening 203 of the sleeve member. The recess 215 is preferably located an axial distance from the adapter body 130 so that the recess engagement member 212 is aligned with the recess 215 when the end 132 of the adapter body 130 abuts the end 204 of the sleeve member. The first recess engagement member 211 of the sleeve member similarly engages the recess 125 when the drill shank is disposed first opening of the sleeve member.

In FIG. 1, a first axial counterbore 221 having a diameter greater than a diameter of the first fastener engagement surface 208 is disposed in the first end 202 of the sleeve member, and a second axial counterbore 222 having a diameter greater than a diameter of the second fastener engagement surface 209 is disposed in the second end 204 of the sleeve member. The axial depth of the first and second counterbores 221 and 222 is sized so that when the corresponding end 202 and 204 of the sleeve member engages the work piece, the corresponding fastener engagement surface 208 or 209 disengages or releases the fastener.

Figure 4:
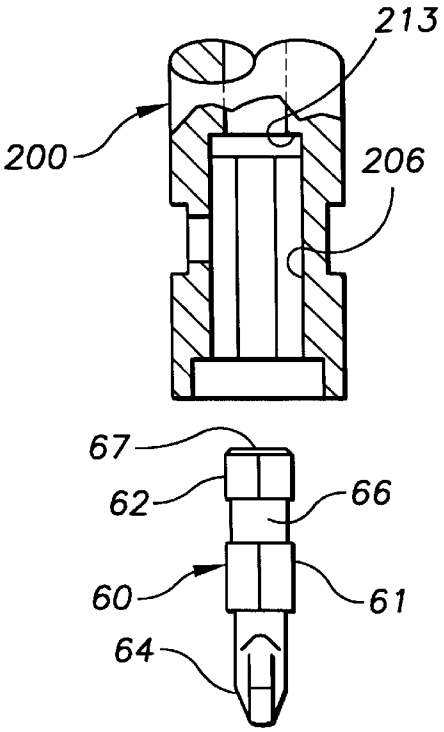
FIG. 4 is a partial sectional view of an end portion of the sleeve member and a screw driver bit retainably disposable into an axial opening thereof.

FIG. 4 illustrates a screw driver bit 60 having a generally axial body member 61 with an outer bit engagement surface 62 and a screw driver end 64 having a Philips configuration. Alternatively, the screw driver end 64 may have any other configuration, for example a standard driver blade, or a hex end or other shape. At least a portion of the body member 61 is axially disposable into the one of the first or second openings 201 or 203 of the sleeve member so that the outer bit engagement surface 62 is engagable with the first or second sleeve engagement surface 206 or 207 to rotationally engage the screw driver bit 60 and the sleeve member 200.

The screw driver bit 60 also preferably comprises a recess formed on the outer portion thereof, and preferably an annular recess 66 formed about the bit engagement surface 62 thereof. The first or second recess engagement member 211 or 212 of the sleeve member is biased to protrude into the corresponding first or second axial opening 201 or 203 of the sleeve member where it engages the recess 66 of the screw driver bit to axially retain the screw driver bit therein. The recess 66 is preferably located an axial distance from an end 67 of the body member 61 so that the recess engagement member of the sleeve member is aligned with the recess 66 of the screw driver bit 60 when the end 67 of the screw driver bit abuts a shoulder 213 on the opening of the sleeve member.

The axial length of the screw driver bit body member 61 may be sized so that the screw driver end 64 thereof is either recessed in or protrudes from the sleeve member 200. In embodiments where the screw driver end 64 is recessed in the sleeve member, the extent of the recessing of the screw driver end 64 relative to the counterbore in the sleeve member may be such that the screw driver end 64 disengages or releases the fastener when the sleeve member end engages the work piece.

The drill adapter 100 may be formed of a metal material in a casting or forging operation. The sleeve member 200 may also be formed of a metal material in a casting or other known forming operation.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A combination drilling and wrenching tool for use with a rotary power tool, comprising:

a drill adapter having a chuck shank on one end thereof and a drill shank on an opposite end thereof, the drill shank having an outer shank engagement surface, the drill adapter having an axial drill bit bore disposed in the drill shank;

a generally cylindrical sleeve member having a first end with a first axial opening and a second opposite end with a second axial opening, a first sleeve engagement surface on the first axial opening of the sleeve member, a second sleeve engagement surface on the second axial opening of the sleeve member, a first fastener engagement surface on the first axial opening of the sleeve member, a second fastener engagement surface on the second axial opening of the sleeve member, the first and second fastener engagement surfaces having different sizes, the drill shank axially disposable into the first or second axial opening of the sleeve member, the outer shank engagement surface of the drill shank engaged with the first sleeve engagement surface when the drill shank is disposed in the first axial opening of the sleeve member, and the outer shank engagement surface of the drill shank engaged with the second sleeve engagement surface when the drill shank is disposed in the second axial opening of the sleeve member.

2. The tool of claim 1, the first fastener engagement surface disposed between the first sleeve engagement surface and the first end of the sleeve member, and the second fastener engagement surface disposed between the second sleeve engagement surface and the second end of the sleeve member.

3. The tool of claim 2, the first fastener engagement surface comprising a portion of the first sleeve engagement surface.

4. The tool of claim 1, a first axial counterbore disposed in the first end of the sleeve member, the first axial counterbore having a diameter greater than a diameter of the first fastener engagement surface, a second axial counterbore disposed in the second end of the sleeve member, the second axial counterbore having a diameter greater than a diameter of the second fastener engagement surface.

5. The tool of claim 1, a drill bit disposed in the axial drill bit bore of the drill adapter, the drill bit disposable into the first or second axial opening of the sleeve member when the drill shank is disposed therein.

6. The tool of claim 1, the outer shank engagement surface of the drill adapter having a polygonal shape, the first and second sleeve engagement surfaces of the sleeve member having a polygonal shape complementary to the polygonal shape of the outer shank engagement surface of the drill adapter.

7. The tool of claim 1, the sleeve member is hollow, the first and second fastener engagement surfaces having a polygonal shape.

8. The tool of claim 7, the second fastener engagement surface disposed between the second sleeve engagement surface and the second end of the sleeve member, the second fastener engagement surface having a diameter greater than a diameter of the second sleeve engagement surface.

9. The tool of claim 1, the drill shank of the drill adapter having a recess on an outer portion thereof, a first recess engagement member biased to protrude into the first axial opening of the sleeve member, a second recess engagement member biased to protrude into the second axial opening of the sleeve member, the first or second recess engagement member engagable with the recess of the drill adapter to axially retain the drill shank in the first or second axial opening of the sleeve member.

10. A combination drilling and wrenching tool comprising:

a drill adapter having a chuck shank on one end thereof and a drill shank on an opposite end thereof;

a sleeve member having a first end with a first opening and a second opposite end with a second opening, the first opening having a first sleeve engagement surface and a first fastener engagement surface, the second opening having a second sleeve engagement surface and a second fastener engagement surface sized differently than the first fastener engagement surface, the drill shank interchangeably disposable into the first and second openings of the sleeve member and engageable with the corresponding first and second sleeve engagement surface thereof.

11. The tool of claim 10, a drill bit protruding axially from the drill shank, the drill bit axially disposable into the first or second opening of the sleeve member when the drill shank is disposed therein.

12. The tool of claim 10, the first fastener engagement surface disposed between the first sleeve engagement surface and the first end of thc sleeve member, the second fastener engagement surface disposed between the second sleeve engagement surface and the second end of the sleeve member.

13. The tool of claim 10, a first counterbore disposed in the first end of the sleeve member, the first counterbore having a diameter greater than a diameter of the first fastener engagement surface, a second counterbore disposed in the second end of the sleeve member, the second counterbore having a diameter greater than a diameter of the second fastener engagement surface.

14. The tool of claim 10, an outer shank engagement surface on the drill shank, the first and second sleeve engagement surfaces of the sleeve member having a shape complementary to the shape of the outer shank engagement surface.

15. The tool of claim 14, the first and second fastener engagement surfaces having a polygonal shape.

16. The tool of claim 10, the second fastener engagement surface disposed between the second sleeve engagement surface and the second end of the sleeve member, the second fastener engagement surface having a diameter greater than a diameter of the second sleeve engagement surface.

17. The tool of claim 10, a screw driver bit having a generally axial body member with an outer bit engagement surface, at least a portion of the body member axially disposable into the first opening of the sleeve member, the outer bit engagement surface of the screw head driver bit engagable with the first sleeve engagement surface to rotationally engage the screw driver bit and the sleeve member.

18. The tool of claim 10, the sleeve member is hollow, the first and second openings form a continuous axial opening through the sleeve member.

19. A drilling and wrenching system comprising:

a rotary power tool having a rotatable chuck;

a drill adapter having a chuck shank on one end thereof and a drill shank on an opposite end thereof, the chuck shank disposed and retained in the chuck of the rotary power tool;

a drill bit protruding axially from the drill shank;

a generally cylindrical sleeve member having a first end with a first axial opening and a second opposite end with a second axial opening, the first axial opening having a first sleeve engagement surface and a first fastener engagement surface, the second axial opening having a second sleeve engagement surface and a second fastener engagement surface, the first fastener engagement surface different than the second fastener engagement surface, the drill shank and the drill bit protruding axially therefrom interchangeably disposable into the first and second axial openings of the sleeve member and the drill shank engageable with the corresponding first and second sleeve engagement surface thereof.

20. The system of claim 19, the first fastener engagement surface disposed between the first sleeve engagement surface and the first end of the sleeve member, and the second fastener engagement surface disposed between the second sleeve engagement surface and the second end of the sleeve member.

21. The system of claim 20, the first fastener engagement surface comprising a portion of the first sleeve engagement surface.

22. The system of claim 19, a first axial counterbore disposed in the first end of the sleeve member, the first axial counterbore having a diameter greater than a diameter of the first fastener engagement surface, a second axial counterbore disposed in the second end of the sleeve member, the second axial counterbore having a diameter greater than a diameter of the second fastener engagement surface.

23. The system of claim 19, an outer shank engagement surface of the drill shank having a polygonal shape, the first and second sleeve engagement surfaces of the sleeve member having a polygonal shape complementary to the polygonal shape of the outer shank engagement surface.

24. The system of claim 19, the first and second fastener engagement surfaces having a polygonal shape.

25. The system of claim 24, the second fastener engagement surface disposed between the second sleeve engagement surface and the second end of the sleeve member, the second fastener engagement surface having a diameter greater than a diameter of the second sleeve engagement surface.

26. The system of claim 19, the drill shank of the drill adapter having a recess on an outer portion thereof, a first recess engagement member biased to protrude into the first axial opening of the sleeve member, a second recess engagement member biased to protrude into the second axial opening of the sleeve member, the first or second recess engagement member engagable with the recess of the drill adapter to axially retain the drill shank in the first or second axial opening of the sleeve member.

27. A combination drilling and wrenching tool for use with a rotary power tool, comprising:

a drill adapter having a chuck shank on one end thereof and a drill shank on an opposite end thereof;

a generally cylindrical sleeve member having a first end with a first axial opening and a second opposite end with a second axial opening, a first sleeve engagement surface on the first axial opening of the sleeve member, a second sleeve engagement surface on the second axial opening of the sleeve member, a first fastener engagement surface on the first axial opening of the sleeve member, a second fastener engagement surface on the second axial opening of the sleeve member, the second fastener engagement surface disposed between the second sleeve engagement surface and the second end of the sleeve member, the second fastener engagement surface having a diameter greater than a diameter of the second sleeve engagement surface, the drill shank axially disposable into the first or second axial opening of the sleeve member, the drill shank engaged with the first sleeve engagement surface when the drill shank is disposed in the first axial opening of the sleeve member, and the drill shank engaged with the second sleeve engagement surface when the drill shank is disposed in the second axial opening of the sleeve member.

* * * * *